US007025573B1

(12) United States Patent
Hardin et al.

(10) Patent No.: US 7,025,573 B1
(45) Date of Patent: Apr. 11, 2006

(54) STORAGE CONTAINER FOR AIR COMPRESSOR

(75) Inventors: John W. Hardin, Medina, TN (US); Gary Krentzer, Jackson, TN (US); Travis Patterson, Jackson, TN (US); Mark W. Wood, Jackson, TN (US); Steve A. Jordan, Medina, TN (US); James Vintzel, Jackson, TN (US); J. Cody Stilwell, Jackson, TN (US); Gary D. White, Medina, TN (US); Stephen J. Vos, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/982,395

(22) Filed: Nov. 5, 2004

Related U.S. Application Data

(63) Continuation-in-part of application No. 10/444,708, filed on May 23, 2003, and a continuation-in-part of application No. 10/410,129, filed on Apr. 9, 2003, now Pat. No. 6,923,627, and a continuation-in-part of application No. 29/179,391, filed on Apr. 9, 2003, now Pat. No. Des. 491,197.

(60) Provisional application No. 60/517,644, filed on Nov. 5, 2003, provisional application No. 60/469,645, filed on May 12, 2003.

(51) Int. Cl.
*F04B 53/00* (2006.01)

(52) U.S. Cl. ..... 417/234; 417/572

(58) Field of Classification Search ..... 417/234, 417/572, 313, 415, 410.1
See application file for complete search history.

(56) References Cited

U.S. PATENT DOCUMENTS

| | | | | |
|---|---|---|---|---|
| 4,009,891 | A * | 3/1977 | Jensen | 280/651 |
| D273,522 | S * | 4/1984 | Zastera | D34/17 |
| 4,451,053 | A * | 5/1984 | Alioa et al. | 280/47.26 |
| D289,578 | S * | 4/1987 | Ruffin | D34/17 |
| 6,454,281 | B1 * | 9/2002 | Pearson | 280/47.26 |
| 6,582,201 | B1 * | 6/2003 | Lucchi | 417/234 |
| 2002/0044871 | A1 * | 4/2002 | Montgomery | 417/201 |
| 2003/0180156 | A1 * | 9/2003 | Brashears et al. | 417/234 |
| 2004/0071561 | A1 * | 4/2004 | Baron et al. | 417/234 |

FOREIGN PATENT DOCUMENTS

JP 2002285967 A * 10/2002

* cited by examiner

*Primary Examiner*—Charles G. Freay
(74) *Attorney, Agent, or Firm*—Suiter West Swantz pc llo

(57) ABSTRACT

The present invention is directed to a suitcase style air compressor assembly having an extensible handle bar assembly, a wheel assembly, and a integral storage container. When the extensible handle bar assembly is fully extended, the suitcase style air compressor assembly may be transported by utilizing the extensible handle bar assembly and the wheel assembly. When the suitcase style air compressor assembly reaches a worksite, the extensible handle bar assembly may be retracted so that the suitcase style air compressor assembly does not occupy a large space. The air compressor includes a storage container for storing air hoses, power cords, tools, and the like.

39 Claims, 10 Drawing Sheets

STORAGE CONTAINER FOR AIR COMPRESSOR

CROSS-REFERENCE TO RELATED DOCUMENTS

The present application claims the benefit under 35 U.S.C. § 119(e) of U.S. Provisional Application Ser. No. 60/517,644, filed Nov. 5, 2003. The present application is a continuation-in-part under 35 U.S.C. § 120 of U.S. application Ser. No. 10/410,129 now U.S. Pat. No. 6,923,627, filed on Apr. 9, 2003, Ser. No. 29/179,391 now Des. Pat. No. 491,197, filed on Apr. 9, 2003, and Ser. No. 10/444,708, filed on May 23, 2003. The present application incorporates the following applications by reference in their entirety: U.S. application Ser. No. 10/410,129, filed Apr. 9, 2003; U.S. application Ser. No. 29/179,391, filed Apr. 9, 2003; U.S. Provisional Application Ser. No. 60/469,645, filed May 12, 2003; U.S. application Ser. No. 10/444,708, filed May 23, 2003; China Patent Serial No. 2L 03358051, filed Aug. 27, 2003; China Application Serial No. 03156352.X, filed Sep. 4, 2003, and U.S. Provisional Application Ser. No. 60/517,644, filed Nov. 5, 2003.

FIELD OF THE INVENTION

The present invention relates generally to the field of air compressors, and more particularly to a suitcase style air compressor assembly having an integral storage container for storing air hoses, power cords, tools, and the like.

BACKGROUND OF THE INVENTION

Air compressor assemblies are used to provide compressed air for operating air powered tools such as nailing tools, socket driving tools, material shaping tools, sanding tools, spray painting tools, inflation chucks, and the like. In order to allow such assemblies to be transported more easily, air compressor assemblies have been designed to be portable. Conventionally, portable air compressor assemblies have been designed like a wheelbarrow, having a handle bar assembly and a wheel assembly. An operator often transports the conventional portable air compressor assembly by pushing or pulling the handle bar assembly so that the air compressor assembly may move forward on the wheel assembly.

Although portable air compressor assemblies presently known in the art have greatly increased the ease in which such assemblies are transported, many limitations are associated with such assemblies. First, the handle bar assembly associated with the conventional portable air compressor assembly is long thereby resulting in a large, bulkly assembly which occupies a large amount of space. Such design may lead to operational difficulties (i.e. need for an air compressor at a worksite with limited workspace). Second, transportation of air compressor components and other materials necessary to perform a particular job is often cumbersome for the lack of a storage compartment on the air compressor assembly. Such limitation causes the user to have to carry components separate from the air compressor assembly as well as find storage space for such components once at the worksite.

Thus, it would be advantageous to provide an air compressor assembly that is easily transportable with a handle bar assembly and a wheel assembly yet compact enough that the air compressor assembly does not occupy a large space. It would further be advantageous to provide such an air compressor with a storage container for storing air hoses, power cords, tools, and the like.

SUMMARY OF THE INVENTION

Accordingly, the present invention is directed to a suitcase style air compressor assembly having an extensible handle bar assembly, a wheel assembly, and an integral storage container. When the extensible handle bar assembly is extended, the suitcase style air compressor assembly may be transported easily by utilizing the extensible handle bar assembly and the wheel assembly. Further, air compressor hoses, power cords, tools, and the like may also be easily transported via the integral storage container disposed within the air compressor assembly. When the suitcase style air compressor assembly reaches a worksite, the extensible handle bar assembly may be retracted so that the suitcase style air compressor assembly is more compact and does not require a large space to operate. In addition, air compressor components and the like may be stored in the integral storage container until needed without requiring additional storage space to be found at the worksite.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which:

FIG. 9 is an end view of an air compressor assembly in accordance with the present invention, wherein the air compressor is provided with an integral storage container for storing air hoses, power cords, tools, and the like;

DETAILED DESCRIPTION OF THE INVENTION

Reference will now be made in detail to the presently preferred embodiments of the invention, examples of which are illustrated in the accompanying drawings.

Figure 1:
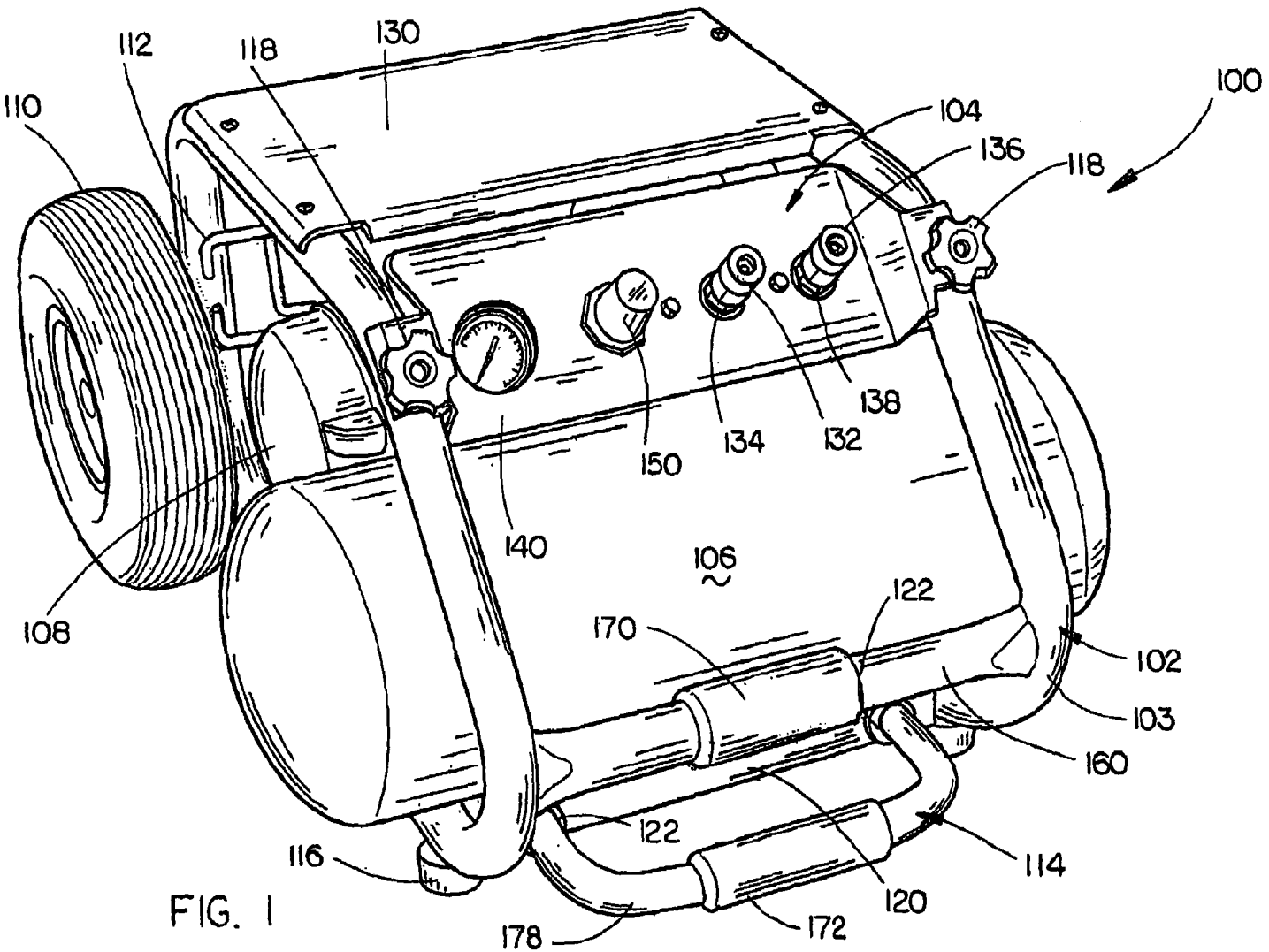
FIG. 1 is an isometric view illustrating an air compressor assembly having an extensible handle bar assembly in accordance with an exemplary embodiment of the present invention.
Figure 6:
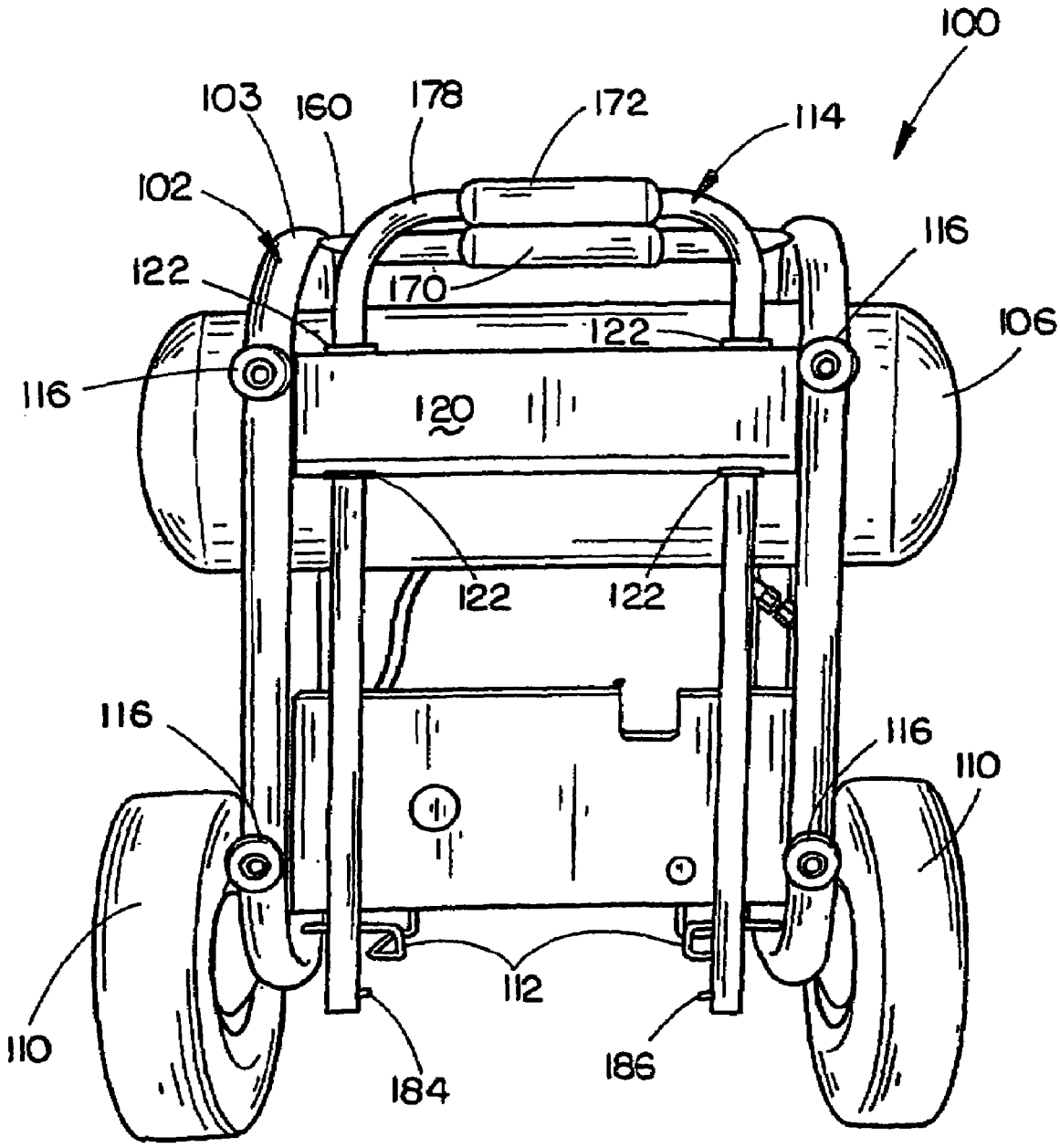
FIG. 6 is a bottom view of the air compressor assembly as shown in FIG. 1, wherein another exemplary embodiment of the extensible handle bar assembly is shown.

Referring generally to FIGS. 1 and 6, an air compressor assembly 100 having an extensible handle bar assembly 114 in accordance with exemplary embodiments of the present invention is shown. The air compressor assembly 100 includes an air storage tank 106 for storing compressed air, an air compressor 108 for supplying compressed air to the air storage tank 106, and a removable manifold assembly 104 for controlling and distributing compressed air from the air compressor assembly 100 to one or more air powered tools.

The air compressor assembly 100 is equipped with a roll cage assembly 102 which includes a roll cage 103 that substantially encloses the air storage tank 106 and the air compressor 108 to protect these components from damage due to contact with foreign objects. The air storage tank 106 may be mounted (e.g., welded, or the like) to the roll cage 103.

The roll cage assembly 102 may include a support member 120 mounted to the roll cage 103. In one embodiment, the support member 120 is welded to the roll cage 103. Alternatively, the support member 120 is mounted to the roll cage 102 through fasteners such as screws, bolts, and the like. The support member 120 may have passages 122 defined therein. In one embodiment, the support member 120 is placed beneath the air storage tank 106 to help support the weight of the air storage tank 106. Alternatively, the support member 120 is placed beneath the air compressor 108 to help support the weight of the air compressor 108.

A cover member 130 may be placed on the top of the roll cage 103 to protect the air compressor 108 from contact with foreign objects. A lifting handle assembly 160 may be mounted to the roll cage 103 for lifting the air compressor assembly 100. For example, the lifting handle assembly 160 may be welded to the roll cage 102. The lifting handle assembly 160 may include a grip 170 for easy grasping.

Figure 2:
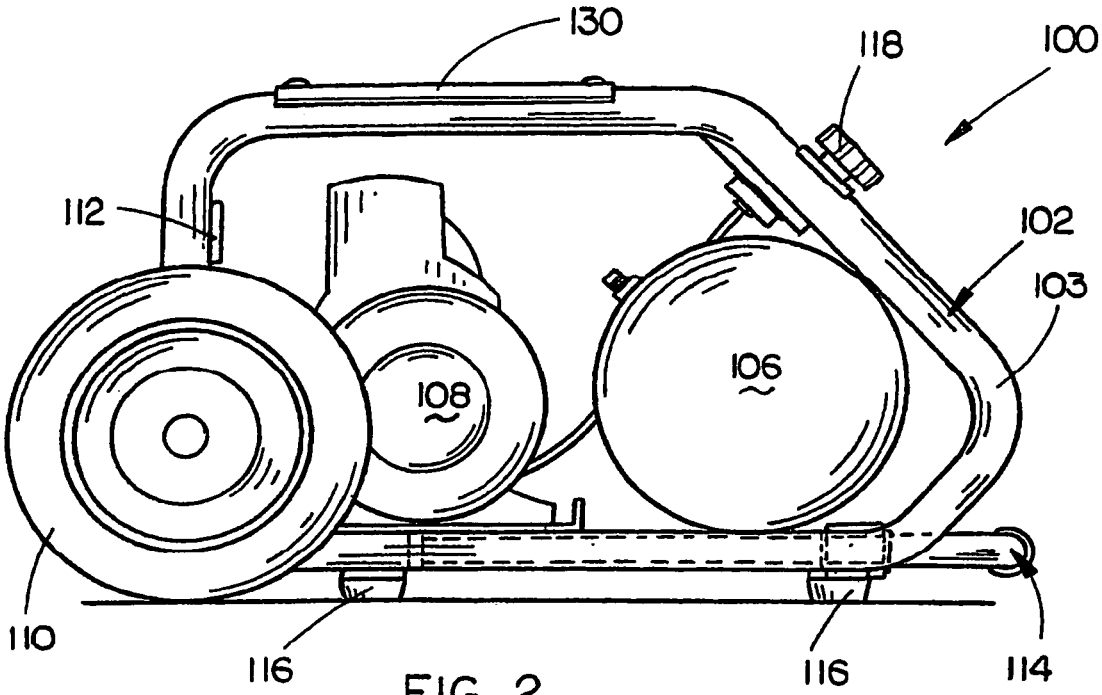
FIG. 2 is a side view of the air compressor assembly as shown in FIG. 1.
Figure 3:
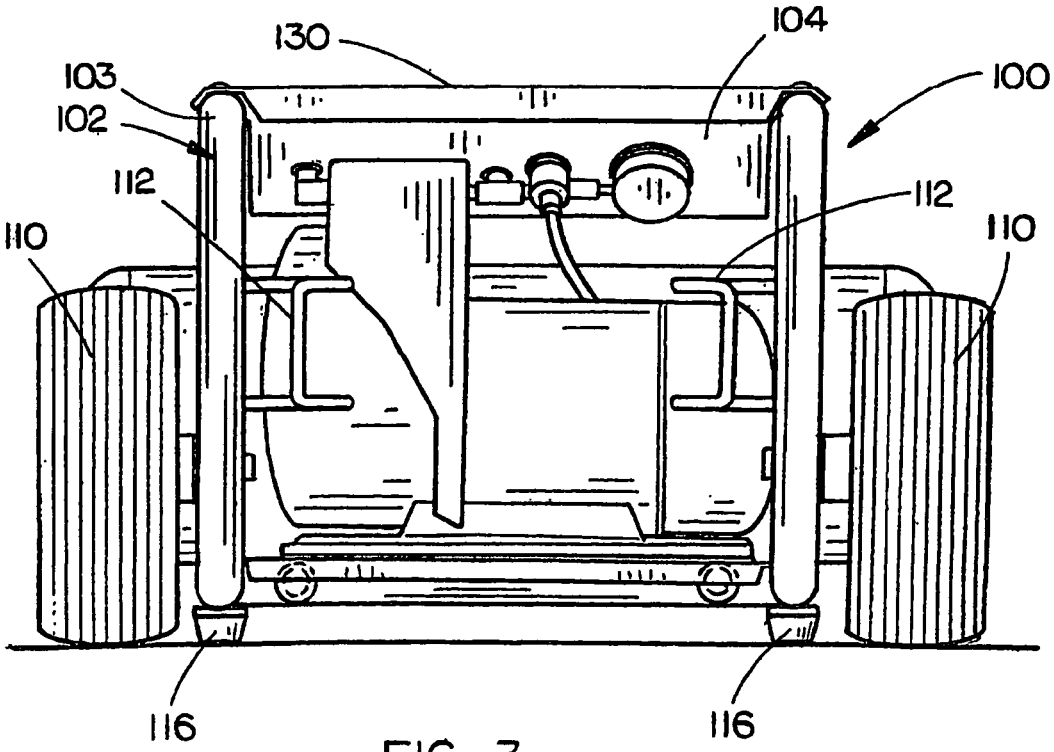
FIG. 3 is an end view of the air compressor assembly as shown in FIG. 1.

The air compressor assembly 100 may have a wheel assembly 110 mounted to the roll cage assembly 102 so that the air compressor assembly 100 may be transported on wheels. Cushion members 116 may be mounted to the roll cage 103 to support, along with the wheel assembly 110, the weight of the air compressor assembly 100 when the air compressor assembly 100 rests, for example, on the ground (see, FIGS. 2 and 3). A cord drop assembly 112 may be mounted to the roll cage 103.

Figure 4:
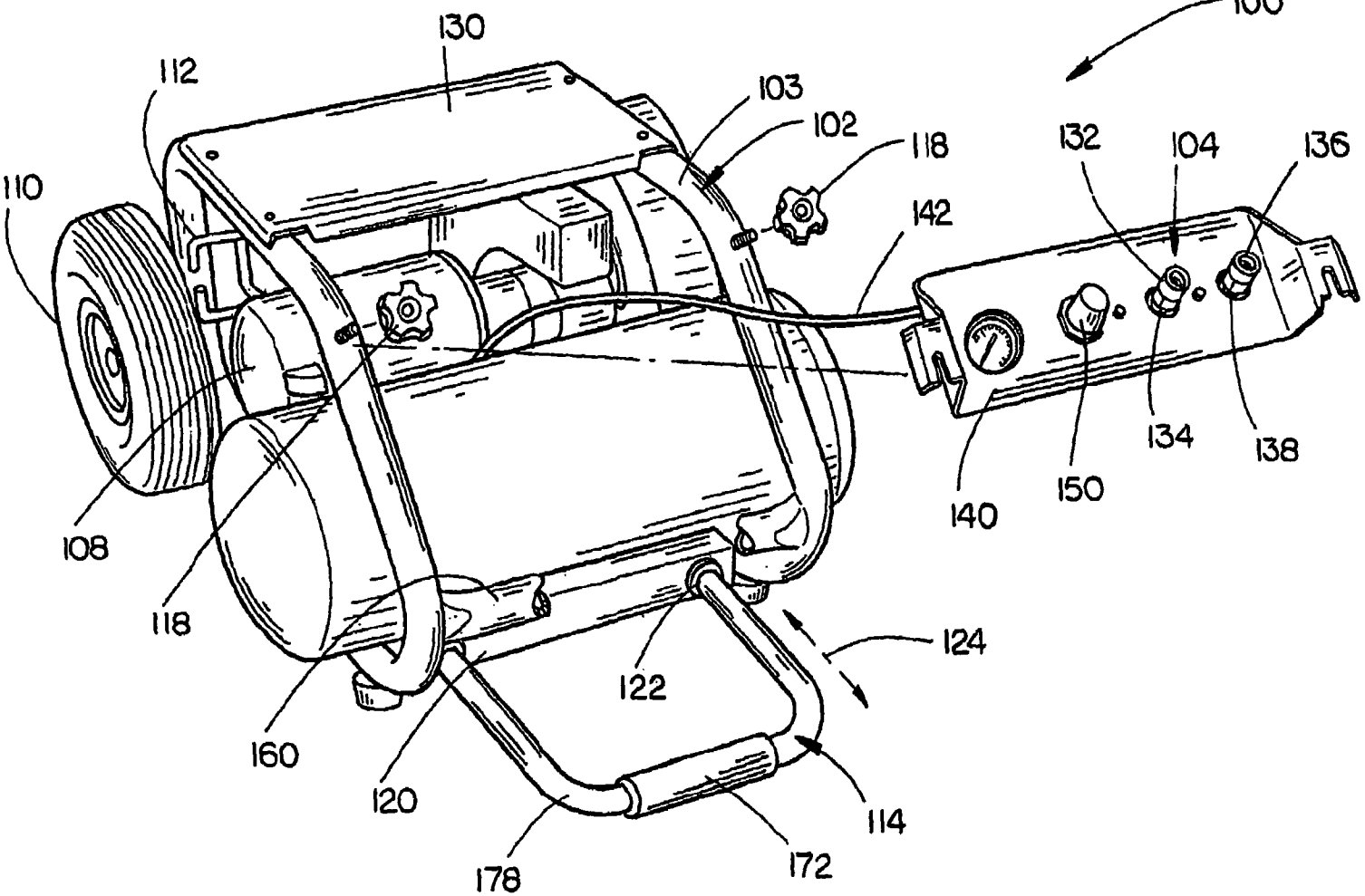
FIG. 4 is an isometric view of the air compressor assembly as shown in FIG. 1, wherein a manifold assembly is removed from a roll cage of the air compressor assembly and the extensible handle bar assembly is partially extended.

As shown in FIGS. 1 and 4, the manifold assembly 104 may include a pneumatic manifold (not shown) and at least one pressure regulator assembly 150, coupled to a supporting frame 140. Outlet ports 134, 138 within the pneumatic manifold are fitted with suitable couplers or connectors 132, 136 which extend through apertures in the frame 140 for allowing attachment and removal of air hoses to provide compressed air to one or more air powered tools. In exemplary embodiments of the invention, couplers 132, 136 may be comprised of quick-connect coupler bodies for allowing attachment and removal of air hoses without the use of tools. Alternatively, one or more of the outlet ports 134, 138 may be fitted with a quick-connect coupler plug or stud allowing attachment of air hoses equipped with a quick-connect coupler bodies, a threaded connector (male or female), or the like as contemplated by one of ordinary skill in the art.

As shown in FIG. 1, the manifold assembly 104 may be mounted to the roll cage 103 through fasteners 118 such as screws, bolts, and the like. Alternatively, the manifold assembly 104 may be removed from the roll cage 103 and coupled thereto via a single air hose 142 so the manifold assembly 104 may be utilized at locations remote from the air compressor assembly 100, as shown in FIG. 4.

Figure 5:
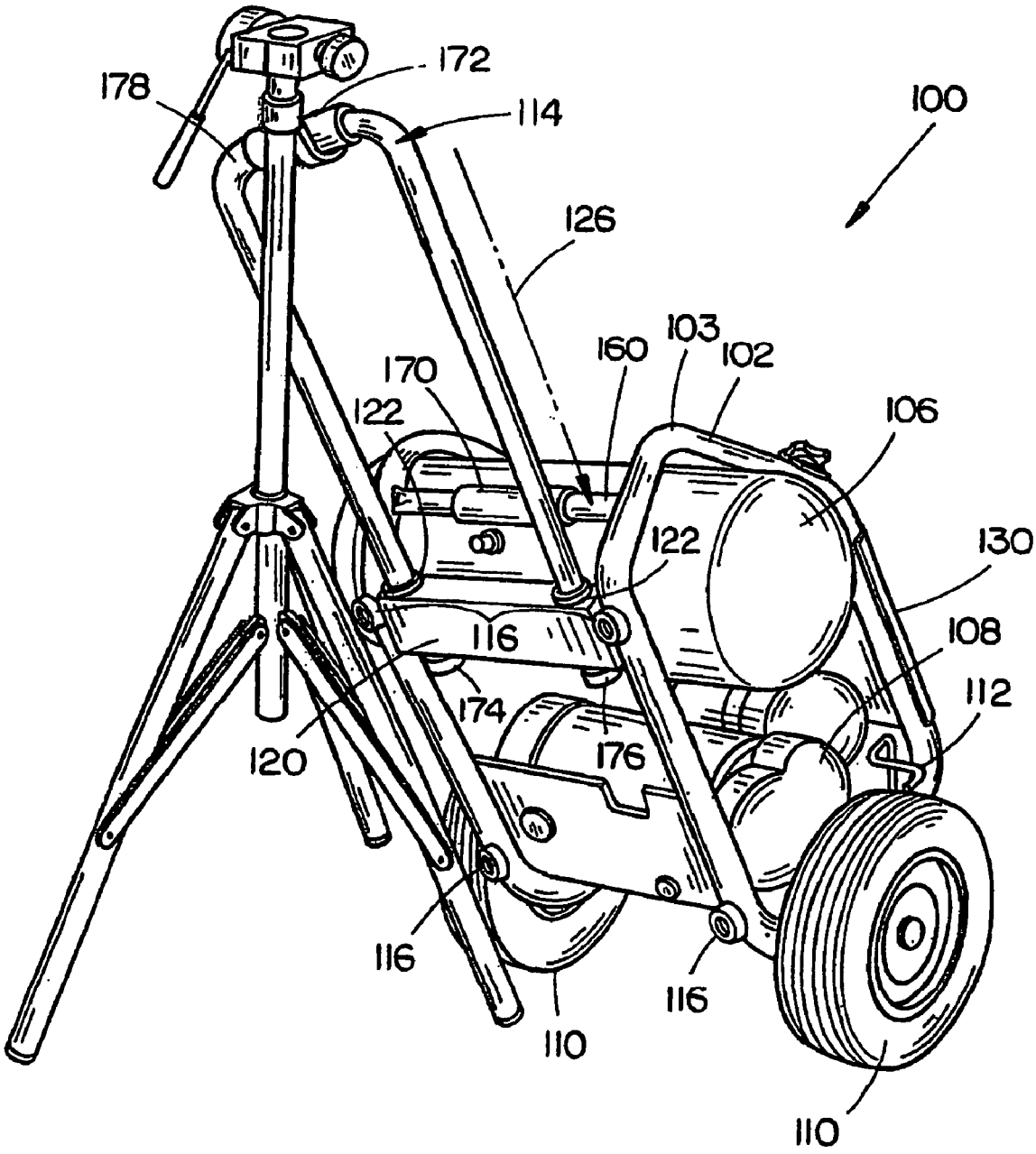
FIG. 5 is an isometric view of the air compressor assembly as shown in FIG. 1, wherein an exemplary embodiment of the extensible handle bar assembly is fully extended.

Referring to FIGS. 5 and 6, exemplary embodiments of the extensible handle bar assembly 114 shown in FIGS. 1 through 4 in accordance with the present invention are shown. The extensible handle bar assembly 114 may include a substantially U shaped handle bar 178, and a grip 172 attached to the handle bar 178 for easy grasping. The handle bar 178 may be made of metal, plastic, or the like. The extensible handle bar assembly 114 is mounted to the roll cage assembly 102 and is capable of telescopic movement. For example, the extensible handle bar assembly 114 may be mounted to the roll cage assembly 102 by inserting legs of the handle bar 178 into the passages 122 of the support member 120 and is capable of telescopic movement (i.e., the handle bar 178 is movable along longitudinal directions of the passages 122).

The handle bar 178 may have stops at end portions of the legs to prevent the extensible handle bar assembly 114 from being pulled out of the passages 122. Thus, the extensible handle bar assembly 114, when fully extended, may cooperate with the wheel assembly 110 to transport the suitcase style air compressor assembly 100. In an exemplary embodiment, as shown in FIG. 5, after the handle bar 178 is inserted into the passages 122, stops may be mounted to end portions 174, 176 of the handle bar 178 so that the end portions 174, 176 are wider than the passages 122, preventing the extensible handle bar assembly 114 from being pulled out of the passages 122. In an additional exemplary embodiment, as shown in FIG. 6, the extensible handle bar assembly 114 may include pins 184, 186 sticking out from the outer surface of end portions of the legs of the handle bar 178 when the pins 184, 186 are not pressed, preventing the extensible handle bar assembly 114 from being pulled out of the passages 122. The pins 184, 186 may be made of metal, plastic, or the like. When pressed, the pins 184, 186 may be pushed inside the handle bar 178 so that the handle bar 178 may be inserted into the passages 122. It is understood that stops at end portions of the legs may have other embodiments as may be contemplated by one of ordinary skill in the art without departing from the scope and spirit of the present invention.

As shown in FIGS. 4 and 5, the extensible handle bar assembly 114 is capable of telescopic movement. For example, as shown in FIG. 4, the extensible handle bar assembly 114 may be retracted or extended along the line 124. When the extensible handle bar assembly 114 is fully retracted (see, e.g., FIG. 1), the air compressor assembly 100 may occupy a small space, and the air compressor assembly 100 may be lifted by grasping the lifting handle assembly 160 and/or the roll cage assembly 102. When the extensible handle bar assembly 114 is fully extended (see, e.g., FIG. 5), the extensible handle bar assembly 114 may cooperate with the wheel assembly 110 for allowing the air compressor assembly 100 to be easily transported. When the air compressor assembly 100 reaches the destination, the extensible handle bar assembly 114 may be rested against a tripod (see, e.g., FIG. 5), or retracted along the direction 126 to save space.

Figure 7:
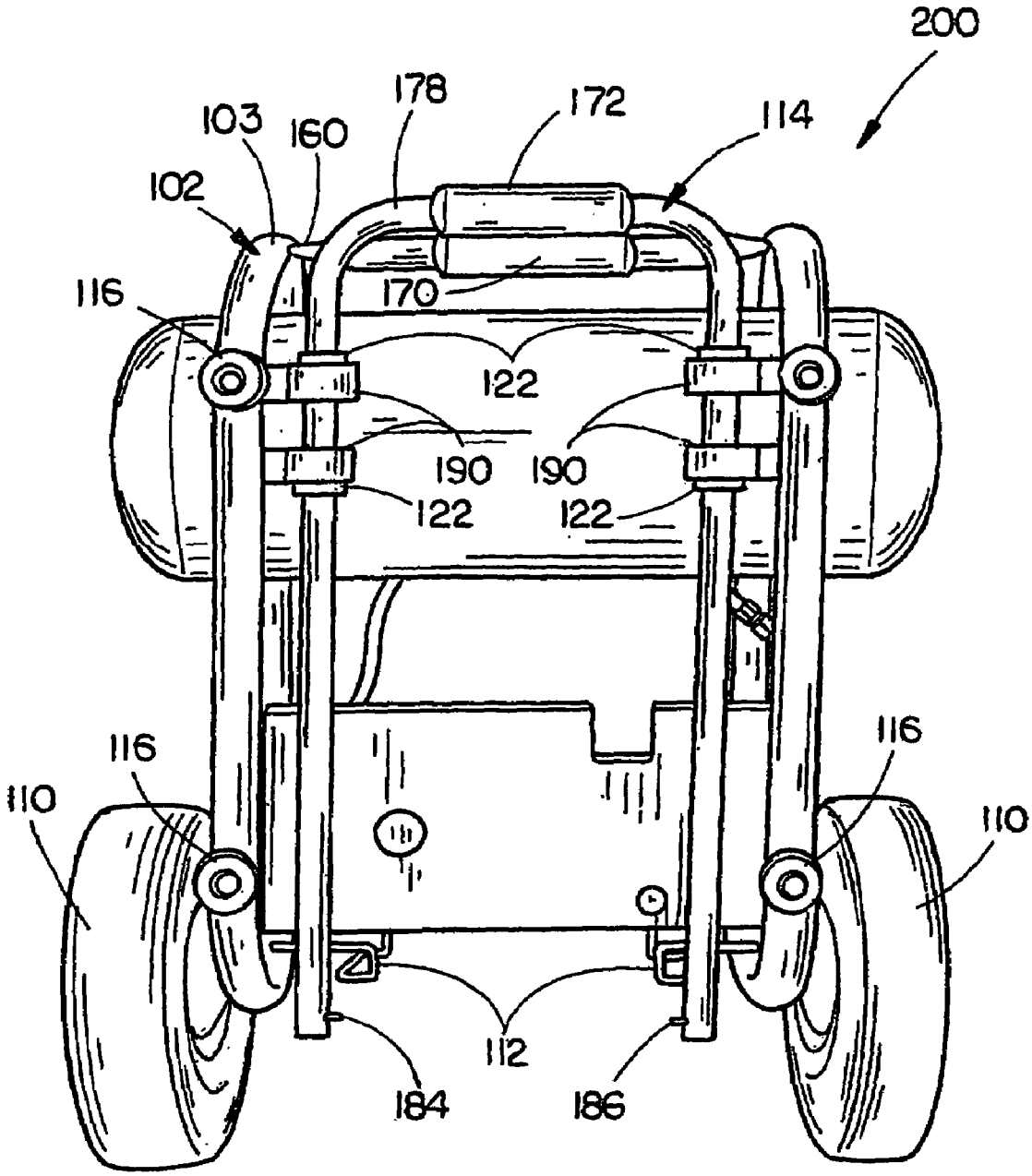
FIG. 7 is a bottom view of an air compressor assembly having an extensible handle bar assembly in accordance with an additional exemplary embodiment of the present invention.

FIG. 7 is a bottom view of an air compressor assembly 200 having an extensible handle bar assembly 114 in accordance with an additional exemplary embodiment of the present invention. The air compressor assembly 200 may have a structure similar to the air compressor assembly 100 as shown in FIGS. 1 through 6. However, the roll cage assembly 102 shown in FIG. 7 does not include the support member 120 as shown in FIGS. 1 through 6. Instead, the roll cage assembly 102 includes brackets 190 mounted to the roll cage 103. The brackets 190 may be made of metal, plastic, or the like. The legs of the handle bar 178 may be inserted into the brackets 190 for telescopic movement (i.e., the handle bar 178 is movable along longitudinal directions of the legs of the handle bar 178).

Figure 8:
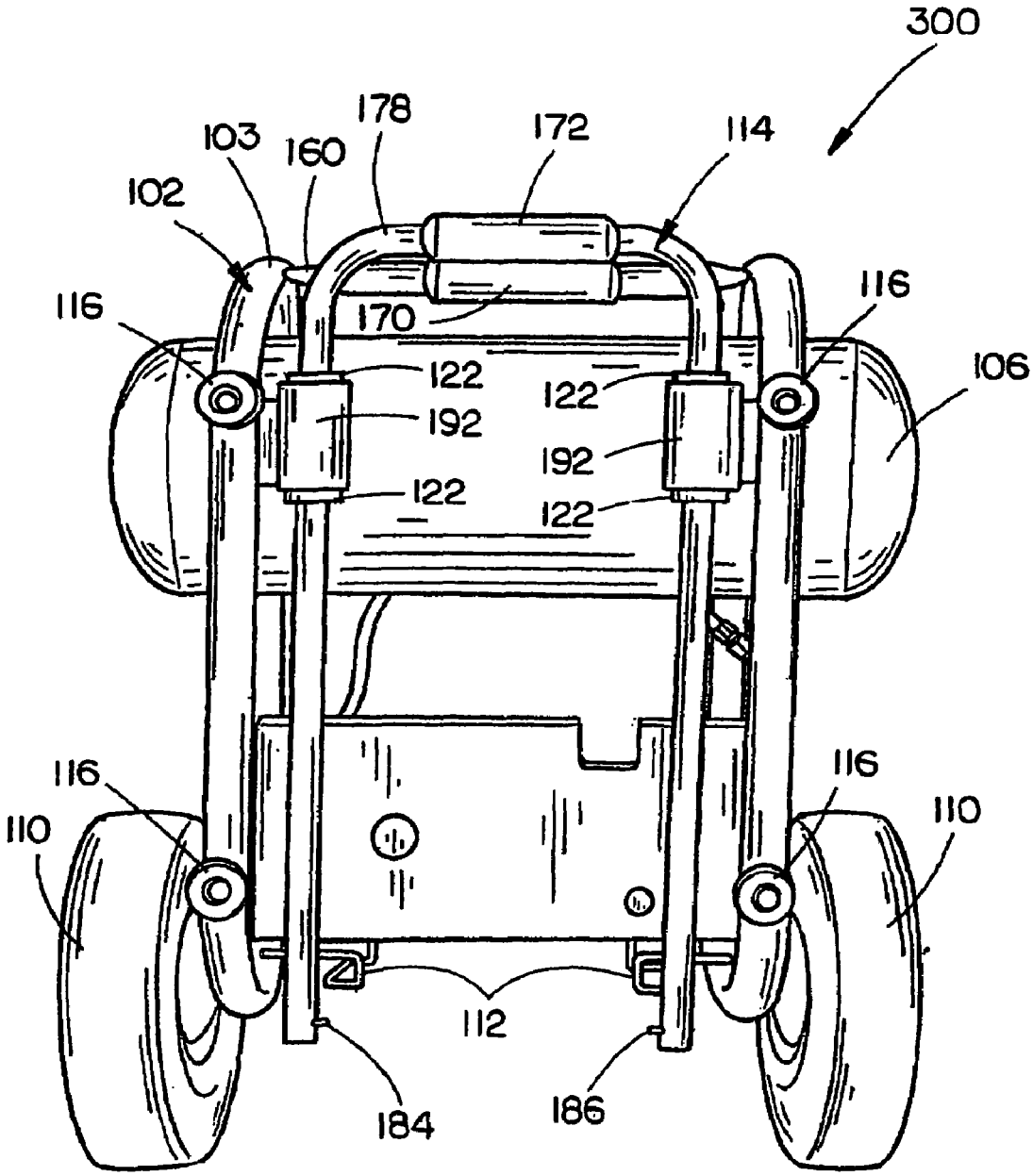
FIG. 8 is a bottom view of an air compressor assembly having an extensible handle bar assembly in accordance with another exemplary embodiment of the present invention.

FIG. 8 is a bottom view of an air compressor assembly having an extensible handle bar assembly in accordance with another exemplary embodiment of the present invention. The air compressor assembly 300 may have a structure similar to the air compressor assembly 100 as shown in FIGS. 1 through 6. However, the roll cage assembly 102 shown in FIG. 8 does not include the support member 120 as shown in FIGS. 1 through 6. Instead, the roll cage assembly 102 includes centrally hollow tubes or cylindrical channels 192 mounted to the roll cage 102. The tubes 192 may be made of metal, plastic, or the like. The legs of the handle bar 178 may be inserted into the pipes 192 for telescopic movement (i.e., the handle bar 178 is movable along longitudinal directions of the tubes 192). It is understood that channels that are not cylindrical may be used instead of the tubes 192 without departing from the scope and spirit of the present invention.

It is understood that the extensible handle bar assembly 114 shown in FIGS. 7 and 8 may include stops as may be contemplated by a person of ordinary skill in the art at the handle bar 178 for preventing the handle bar 178 from being fully pulled out of the roll cage assembly 102.

Figure 9:
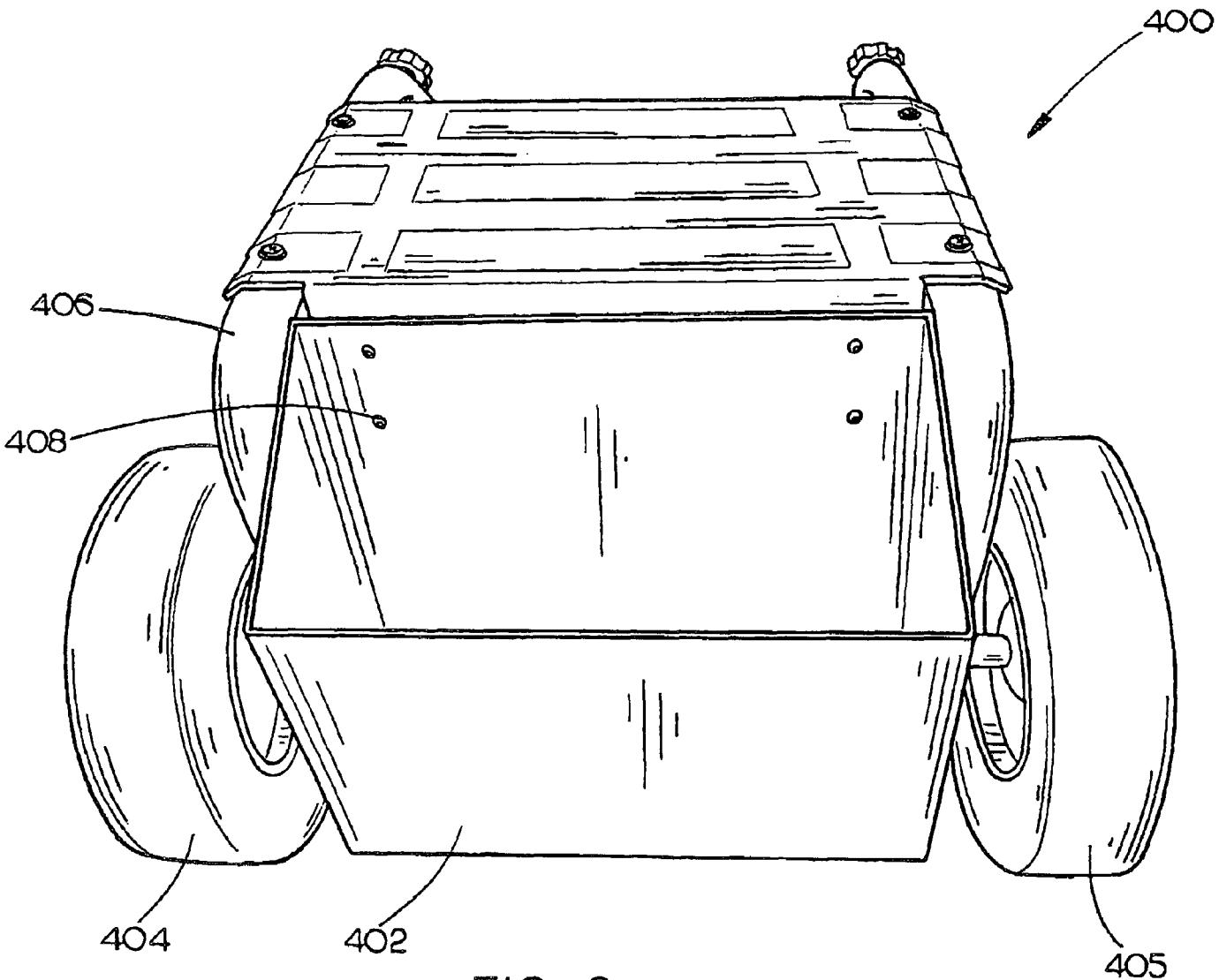
Figure 10:
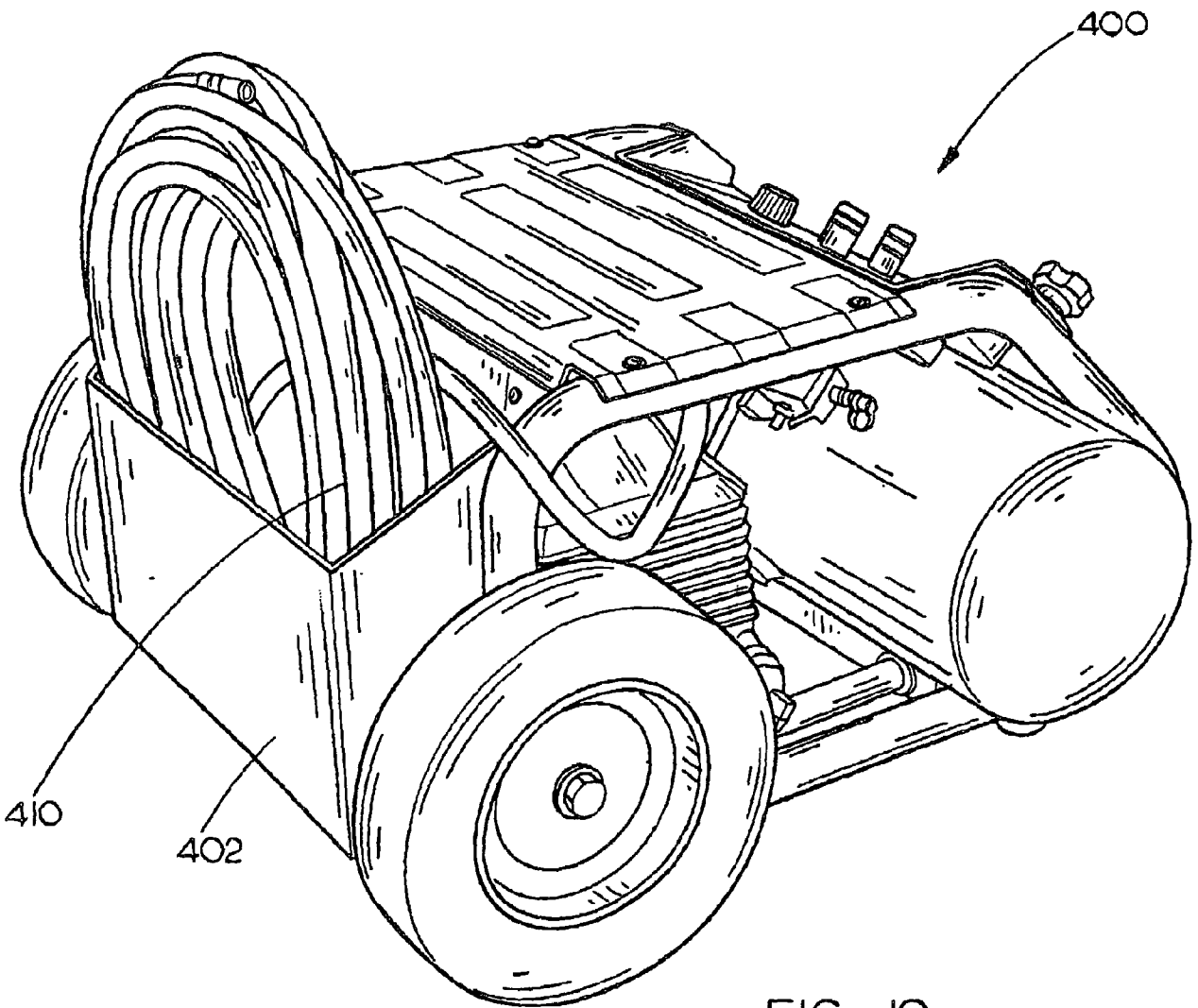
FIG. 10 is a side view of the air compressor assembly as shown in FIG. 9, wherein the air hose for the air compressor is stored within the integral storage container of such assembly.
Figure 11:
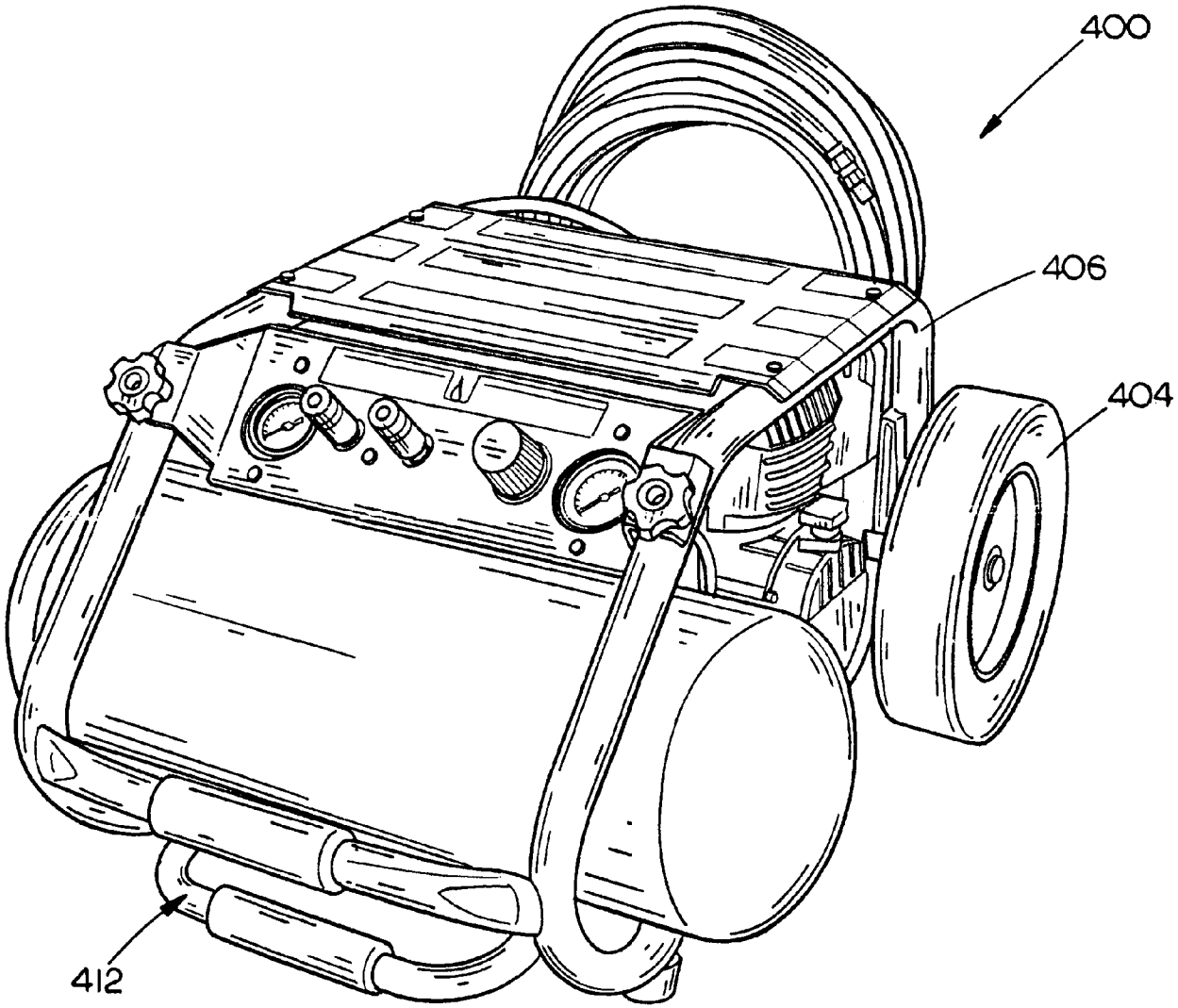
FIG. 11 is an isometric view of the air compressor assembly as shown in FIG. 9, wherein the integral storage compartment is mounted to an air compressor assembly including an extensible handle bar assembly.

FIGS. 9 through 11 illustrate an air compressor assembly 400 in accordance with an exemplary embodiment of the present invention wherein the air compressor assembly 400 is provided with an integral storage container or compartment 402 for storing air hoses, power cords, tools, and the like. The air compressor assembly 400 may have a structure similar to the air compressor assembly 100 as shown in FIGS. 1 through 6, however, air compressor assembly 400 has an integral storage container. As illustrated in FIG. 9, the integral storage container 402 comprises a box-shaped enclosure including five sides. Such container is formed of a suitable material such as a plastic, metal (e.g., steel or aluminum), and the like. Further, the storage container 402 is coupled to the air compressor 400 between the wheels 404, 405. In the present embodiment, storage container 402 is coupled to the rear of the roll cage assembly 406 of the air compressor assembly 400 via fastners 408 including nuts, screws, bolts, and the like. Such design allows a user to remove the storage container 402 if desired. Alternatively, the storage container 402 is welded to the roll cage assembly 406 of the air compressor assembly.

FIG. 10 illustrates the storage container 402 storing an air compressor hose 410 for the air compressor assembly 400. In accordance with an exemplary embodiment of the present invention, the storage container 402 does not include a lid or cover, thereby allowing over-sized tools, hoses, and the like, to be placed therein. It will be appreciated by those of ordinary skill in the art that the storage container may have other shapes, attachment mechanisms, and locations on the air compressor assembly depending on design preferences, the particular design of the air compressor, materials selected, and the like without departing from the scope and spirit of the present invention.

Referring now to FIG. 11, the air compressor assembly 400 including an extensible handle bar assembly 412 with the integral storage container 402 mounted to rear of such air compressor assembly 400 is shown. As illustrated in FIG. 11, the integral storage container 402 is coupled to the rear of the roll cage assembly 406 of the air compressor assembly 400. Further, the integral storage container 402 is sized to allow the air compressor assembly 400 to be transported by a user pulling the handle bar assembly 412, thereby allowing the air compressor assembly 400 to be mobilized by the wheel assembly including wheels 404, 405.

It is understood that the although an integral storage container is shown in FIGS. 9 through 11 on an air compressor assembly with a roll cage assembly including a support member, such container may also be coupled to a roll cage assembly including brackets (air compressor assembly 200, see FIG. 7) or centrally hollow tubes or cylindrical channels (air compressor assembly 300, see FIG. 8).

It is appreciated although a substantially U shaped handle bar is shown in FIGS. 1 through 11, a handle bar in any other shape may be used instead without departing from the scope and spirit of the present invention. For example, in an alternative embodiment, a L shaped single-legged handle bar may be used instead of the substantially U shaped double-legged handle bar.

The suitcase style air compressor assembly in accordance with the present invention may have the following advantages. First, when the extensible handle bar assembly is fully extended, the air compressor assembly may be easily transported by utilizing the extensible handle bar assembly and the wheel assembly. Moreover, the air compressor may also be lifted by grasping the lifting handle assembly and/or the roll cage assembly. In addition, air compressor hoses, power cords, tools, and the like may also be easily transported via the integral storage container disposed within the air compressor assembly. Furthermore, after reaching the worksite, the extensible handle bar assembly may be fully retracted so that the air compressor assembly is more compact and does not require a large space to operate. Additionally, air compressor components and the like may be stored in the integral storage container until needed without requiring additional storage space to be found at the worksite.

It is believed that the suitcase style air compressor assembly of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An air compressor assembly comprising:

an air storage tank for storing compressed air;

an air compressor for supplying compressed air to the air storage tank;

a roll cage assembly, including a roll cage, substantially enclosing the air storage tank and air compressor for protecting the air storage tank and air compressor from damage;

a wheel assembly including a first wheel and a second wheel mounted to the roll cage assembly; and an integral storage container coupled to the roll cage assembly substantially between the first wheel and the second wheel, wherein the integral storage container includes a bin having an open top configured for holding a coiled length of air hose.

2. The air compressor assembly of claim 1, wherein the bin comprises a generally box-shaped enclosure with a plurality of sides.

3. The air compressor assembly of claim 1, wherein the integral storage container is mounted to the rear of the roll cage assembly via a fastener.

4. The air compressor assembly of claim 3, wherein the fastener is selected from the group consisting of nuts, screws, and bolts.

5. The air compressor assembly of claim 1, wherein the integral storage container is made of metal.

6. The air compressor assembly of claim 1, wherein the integral storage container is made of plastic.

7. The air compressor assembly of claim 1, further comprising an extensible handle bar assembly in which the extensible bar assembly is mounted to the roll cage of the roll cage assembly and cooperates with the wheel assembly for transporting the air compressor assembly.

8. The air compressor assembly of claim 7, wherein the extensible handle bar assembly includes a handle bar.

9. The air compressor assembly of claim 8, wherein the handle bar is substantially U shaped.

10. The air compressor assembly of claim 1, wherein the roll cage assembly includes a support member.

11. The air compressor assembly of claim 10, wherein the support member includes a plurality of passages allowing a handle bar assembly to be attached to the support member.

12. The air compressor assembly of claim 11, wherein the handle bar assembly is secured to the support member via the plurality of passages with stops.

13. The air compressor assembly of claim 11, wherein the handle bar assembly is secured in the plurality of passages in the support member by retractable pins.

14. The air compressor assembly of claim 10, wherein the support member is placed beneath the air storage tank to support the weight of the air storage tank.

15. The air compressor assembly of claim 10, wherein the support member is placed beneath the air compressor to support the weight of the air compressor.

16. The air compressor assembly of claim 1, wherein a lifting handle assembly is mounted to the roll cage for lifting the air compressor assembly.

17. The air compressor assembly of claim 1, wherein the roll cage assembly includes hollow tubes or cylindrical channels mounted to the roll cage.

18. The air compressor assembly of claim 1, wherein the roll cage assembly includes brackets mounted to the roll cage.

19. The air compressor assembly of claim 1, wherein the roll cage assembly includes a cover member to protect the air compressor from contact with foreign objects.

20. The air compressor assembly of claim 1, wherein a cord drop assembly is mounted to the roll cage.

21. An air compressor assembly with an integral storage container comprising:

an air storage tank for storing compressed air;

an air compressor for supplying compressed air to the air storage tank;

a roll cage assembly, including a roll cage, substantially enclosing the air storage tank and air compressor for protecting the air storage tank and air compressor from damage;

an extensible handle bar assembly, the extensible bar assembly mounted to the roll cage of the roll cage assembly and cooperates with the wheel assembly for transporting the air compressor assembly; and an integral storage container coupled to the roll cage assembly, wherein the integral storage container includes a bin having an open top configured for holding a coiled length of air hose.

22. The air compressor assembly of claim 21, wherein the bin comprises a generally box-shaped enclosure with a plurality of sides.

23. The air compressor assembly of claim 21, wherein the storage container is coupled to the rear of the roll cage assembly via a fastener.

24. The air compressor assembly of claim 23, wherein the fastener is selected from the group consisting of nuts, screws, and bolts.

25. The air compressor assembly of claim 21, wherein the storage container is made of metal.

26. The air compressor assembly of claim 21, wherein the storage container is made of plastic.

27. The air compressor assembly of claim 21, wherein the extensible handle bar assembly includes a handle bar.

28. The air compressor assembly of claim 21, wherein the roll cage assembly includes a support member.

29. The air compressor assembly of claim 21, wherein a lifting handle assembly is mounted to the roll cage for lifting the air compressor assembly.

30. The air compressor assembly of claim 21, wherein the roll cage assembly includes hollow tubes or cylindrical channels mounted to the roll cage.

31. The air compressor assembly of claim 21, wherein the roll cage assembly includes brackets mounted to the roll cage.

32. The air compressor assembly of claim 21, wherein the roll cage assembly includes a cover member to protect the air compressor from contact with foreign objects.

33. The air compressor assembly of claim 21, wherein a cord drop assembly is mounted to the roll cage.

34. An air compressor assembly comprising:

an air storage tank for storing compressed air;

an air compressor for supplying compressed air to the air storage tank;

a roll cage assembly, including a roll cage, substantially enclosing the air storage tank and air compressor for protecting such components from damage;

an extensible handle bar assembly, the extensible bar assembly mounted to the roll cage of the roll cage assembly and cooperates with the wheel assembly for transporting the air compressor assembly; and means, coupled to the roll cage assembly, for holding a coiled length of air hose.

35. The air compressor assembly of claim 34, wherein the holding means includes an integral box-shaped enclosure with a plurality of sides.

36. The air compressor assembly of claim 35, wherein the integral box-shaped enclosure is coupled to the rear of the roll cage assembly via a fastener.

37. The air compressor assembly of claim 36, wherein the fastener is selected from the group consisting of nuts, screws, and bolts.

38. The air compressor assembly of claim 35, wherein the integral box-shaped enclosure is made of metal.

39. The air compressor assembly of claim 35, wherein the integral box-shaped enclosure is made of plastic.

* * * * *